US009543108B2

(12) United States Patent
Roedhammer et al.

(10) Patent No.: US 9,543,108 B2
(45) Date of Patent: Jan. 10, 2017

(54) ROTATING X-RAY ANODE WITH AN AT LEAST PARTLY RADIALLY ALIGNED GROUND STRUCTURE

(71) Applicant: PLANSEE SE, Reutte (AT)

(72) Inventors: Peter Roedhammer, Ehenbichl (AT); Juergen Schatte, Reutte (AT); Wolfgang Glatz, Reutte (AT); Thomas Mueller, Hoefen (AT)

(73) Assignee: Plansee SE, Reutte (AT)

( * ) Notice: Subject to any disclaimer, the term of this patent is extended or adjusted under 35 U.S.C. 154(b) by 265 days.

(21) Appl. No.: 14/371,228

(22) PCT Filed: Jan. 7, 2013

(86) PCT No.: PCT/AT2013/000001
§ 371 (c)(1),
(2) Date: Jul. 9, 2014

(87) PCT Pub. No.: WO2013/104088
PCT Pub. Date: Jul. 18, 2013

(65) Prior Publication Data

US 2015/0023473 A1 Jan. 22, 2015

(30) Foreign Application Priority Data

Jan. 9, 2012 (AT) ..... GM2/2012

(51) Int. Cl.
*H01J 35/10* (2006.01)
*H01J 9/14* (2006.01)

(52) U.S. Cl.
CPC ..... *H01J 35/101* (2013.01); *H01J 9/14* (2013.01); *H01J 35/10* (2013.01);
(Continued)

(58) Field of Classification Search
CPC ..... H01J 9/14; H01J 35/10; H01J 35/101; H01J 35/105; H01J 2235/083; H01J 2235/085; H01J 2235/87; H01J 2235/086; H01J 2235/1006; H01J 2235/1204; H01J 35/08; H01J 2235/088
See application file for complete search history.

(56) References Cited

U.S. PATENT DOCUMENTS 4,991,194 A 2/1991 Laurent et al.
7,079,625 B2 7/2006 Lenz
(Continued)

FOREIGN PATENT DOCUMENTS

DE 10360018 A1 7/2004
DE 102007024255 A1 11/2007
(Continued)

*Primary Examiner* — Hoon Song
(74) *Attorney, Agent, or Firm* — Laurence A. Greenberg; Werner H. Stemer; Ralph E. Locher

(57) ABSTRACT

A rotating x-ray anode has an annular focal track. The surface of the focal track has a directed ground structure. Over the circumference of the annular focal track and over the radial extent of the focal track, the alignment of the ground structure is inclined relative to a tangential reference direction in the respective surface portion in each case by an angle that lies in the range from 15°, including, up to and including 90°. A corresponding method for producing a rotating x-ray anode is described.

12 Claims, 2 Drawing Sheets

(52) U.S. Cl.
CPC ... *H01J 2235/083* (2013.01); *H01J 2235/085* (2013.01); *H01J 2235/1006* (2013.01)

(56) References Cited

U.S. PATENT DOCUMENTS

| | | | | |
|---|---|---|---|---|
| 7,356,122 | B2 | 4/2008 | Raber et al. | |
| 2004/0208288 | A1 | 10/2004 | Lenz | |
| 2009/0067578 | A1 * | 3/2009 | Behling | H01J 35/10 378/125 |

FOREIGN PATENT DOCUMENTS

| | | | |
|---|---|---|---|
| JP | H01209641 | A | 8/1989 |
| JP | 2005158589 | A | 6/2005 |

* cited by examiner

ROTATING X-RAY ANODE WITH AN AT LEAST PARTLY RADIALLY ALIGNED GROUND STRUCTURE

BACKGROUND OF THE INVENTION

Field of the Invention

The present invention relates to a rotating x-ray anode with an annular focal track, the surface of the focal track having a directed ground structure.

Rotating x-ray anodes are used in x-ray tubes for generating x-ray beams. X-ray machines with such rotating x-ray anodes are used in particular in the medical sector, in the area of imaging diagnostics. During use, electrons are emitted from a cathode of the x-ray tube and accelerated in the form of a focused electron beam onto the rotating x-ray anode that has been set in rotation. A large part of the energy of the electron beam is converted into heat in the rotating x-ray anode, while a small proportion is radiated as x-radiation. The locally released amounts of heat lead to strong heating up of the rotating x-ray anode.

On account of the rotary movement of the rotating x-ray anode, an annular track (focal track) is scanned by the electron beam during use. Rotating x-ray anodes generally have in the region of the focal track a focal track layer formed on a carrier body. Due to the cyclical thermomechanical loading at the focal spot (point of impingement of the electron beam on the rotating x-ray anode), cyclical compressive/tensile stresses occur in the region of the surface of the focal track and in turn lead to plastic deformations in the region of the surface of the focal track and in the body of the rotating x-ray anode. Compressive stresses are in this case caused by expansion of the volume element exposed to the electron beam with respect to the comparatively colder surrounding area. Tensile stresses occur on account of the plastic deformation taking place at high temperatures and on account of the contraction of the previously strongly heated volume element that occurs during the subsequent cooling down. As a consequence of this, a network of microcracks and macrocracks forms on the surface of the focal track. This sometimes involves the formation of cracks with widths of up to more than 100 μm. Such macrocracks have particularly disadvantageous effects on the dose yield, and consequently on the image quality. Furthermore, there is the risk of crack propagation to deep inside the body of the rotating x-ray anode, thereby increasing the risk of a material breakout or a rupture of the rotating x-ray anode.

In DE 10 2007 024 255 A1 it is proposed to introduce a pattern into the surface of the focal track by electrochemical etching.

DE 103 60 018 A1 describes a rotating x-ray anode in which defined microslits are arranged at least in certain regions in the surface concerned. The main basis of both variants is that the defined structures, in which the relative arrangement and the dimensions of the individual grooves or slits are predetermined, essentially achieve the effect of expansion joints. In particular, the intention is to allow a controlled expansion and controlled release of the elastic energy.

Furthermore, it is also described in DE 10 2007 024 255 A1 that the surface structure can serve for controlled microcrack formation. The introduction of such defined structures is a complex process and entails high costs.

BRIEF SUMMARY OF THE INVENTION

Accordingly, the problem addressed by the present invention is that of providing a rotating x-ray anode that is inexpensive to produce and with which the occurrence of fatigue effects during use can be suppressed as effectively as possible. The problem addressed is also that of providing a corresponding method for producing a rotating x-ray anode.

According to the present invention, a rotating x-ray anode with an annular focal track in which the surface of the focal track has a directed ground structure is provided. Over the circumference of the annular focal track and over the radial extent of the focal track, the alignment of the ground structure is inclined in relation to a tangential reference direction in the respective surface portion in each case by an angle in the range from and including 15° up to and including 90°.

In particular, the rotating x-ray anode has these features before it is fitted for the first time into an x-ray tube and is exposed therein to an electron beam. Aging effects, which—as described—lead to modifications of the surface of the focal track, may occur after prolonged periods of use.

In comparison with the solutions known from the prior art of introducing defined slit structures or defined patterns, introduction of a directed ground structure involves much less effort, especially since it is in any case advantageous with regard to the achievement of a surface that is as smooth as possible in the region of the focal track to smooth it in a final surface-working step by grinding. A final surface-working step that is sometimes carried out in the (internal) prior art for the production of rotating x-ray anodes consists in grinding the surface of the focal track and the surrounding regions by a rotating grinding wheel being guided in the circumferential direction over the surface of the focal track in such a way that the alignment of the ground structure is in each case tangential. Accordingly, the production of rotating x-ray anodes according to the invention can largely be realized in a simple manner, without additional effort, by the grinding direction in the final surface-working step being aligned in relation to the respective tangential reference direction in accordance with the claimed angular range.

A further advantage of the aligned ground structure in comparison with the provision described above of defined slit structures or defined patterns intended to serve primarily as expansion joints is that a multiplicity of crack nuclei are provided, finely distributed uniformly over the surface of the focal track. The fact that the individual striae of a ground structure also taper to a comparatively sharp point at the root of the stria means that under tensile stresses there is a pronounced peaking of stress in this region, which is conducive to the introduction of the crack. If tensile stresses occur in the surface of the focal track, the possibility of the formation of microcracks is accordingly provided at a multiplicity of points (and not only at predefined positions) and the surface of the focal track can react to the tensile stresses by the formation of a network of finely distributed microcracks. A formation of wide cracks is thereby avoided. These wide cracks are more likely to occur when only a limited number of defined slits or otherwise defined structures are provided. Another advantage over the provision of defined slit structures or defined patterns is that a comparatively smooth surface of the focal track can be provided, and so the losses from self-absorption are negligible.

In the course of addressing the problem stated above, previous rotating x-ray anodes, which (according to the internal prior art) had a ground structure aligned in the circumferential direction, were thoroughly investigated. After prolonged periods of use of the same it could be found that, although a comparatively fine network of microcracks aligned in the circumferential direction is formed, the network intensifies as the period of use becomes longer, to the extent that the accumulated crack widths increase. In the radial direction, on the other hand, far fewer and much wider cracks occur. Depending on the microstructure of the focal track, these wider cracks may also run irregularly (for example in a zigzag form) near the radial direction and release far more energy per crack event during formation. One effect of this is a high loss of dose, since, with increasing width, the cracks act as an increasingly more efficient electron trap. Another effect is an increase in the probability of particle release due to thermal and mechanical isolation of grains at acute-angled crack intersections, which entails the risk of image-disturbing high-voltage instabilities. It can be deduced from the analyses of the crack patterns that grinding striae promote the formation of microcracks that run along the alignment of the grinding striae as a result of the stress peaking occurring there in response to the compressive/tensile loading in the focal track and in response to the thermal and plastic deformation of the body of the rotating x-ray anode.

It has been found that the formation according to the invention of the rotating x-ray anode, in which the alignment of the ground structure is inclined in relation to a tangential reference direction in the respective surface portion in each case by an angle in the range from and including 15° up to and including 90°, can have the effect of preventing the formation of wide, and particularly critical, cracks running in the radial direction. The respectively locally occurring strain in the region of the surface of the focal track can be determined by simulation, and accordingly the alignment of the ground structure can be chosen in such a way that in each case it runs essentially perpendicularly to the alignment of the maximum local strain. In this respect, the claimed angular range has been found to be an advantageous range.

The term "focal track" is used in the present context to denote the surface portion of the rotating x-ray anode that is intended for scanning with an electron beam (and over which the electron beam is accordingly guided during use). The focal track may accordingly form a surface portion of a separate focal track layer, which is generally of an annular form. However, it may also be formed directly on a body (in this case of an essentially monolithic form) of the rotating x-ray anode. Generally, further layers, attachments, etc., such as for example a graphite ring, etc., may also be provided on the rotating x-ray anode, in particular on the side facing away from the focal track. The term "directed ground structure" is generally used to refer to a surface structuring that is formed by a uniformly distributed array of individual striae or individual grooves, the arrangement and dimensions of which (length, width, depth) are randomly distributed and which are aligned essentially along a preferential direction (i.e. run essentially parallel to one another). Altogether, an essentially smooth surface is thereby achieved. The directed ground structure is undefined to the extent that the position and dimensions of the individual striae are not predetermined, in particular are not periodic or otherwise regular. The directed ground structure may be produced by a relative movement between the implement used to introduce the ground structure (grinding means, such as for example a grinding wheel; polishing body or polishing block and mechanical polishing means used; brush) and the surface of the focal track along the desired alignment. The directed ground structure is introduced in particular by a grinding operation. The term "grinding" is used to refer to a material-removing, path-determined production process for the working of surfaces with grinding means. However, there are in principle also other possibilities for the introduction of the directed ground structure, such as for example by directed polishing (with a mechanical polishing means) or by directed brushing.

The tangential reference direction is determined in each case locally on the surface portion concerned, on which the alignment of the ground structure is to be determined. A tangential direction (or circumferential direction), a radial direction and an axial direction are defined at the point respectively to be characterized on the rotating x-ray anode by the annular form of the focal track. The angle between the tangential reference direction and the alignment of the ground structure is measured in the plane that is formed by the surface of the focal track in this local region (tangential plane at the measuring point). It must be taken into account in this respect that the surface of the focal track in the respective, local region may also be inclined in relation to a radial direction, which is the case in particular with a frustoconical focal track. Alternatively, the focal track may extend exclusively in the plane that is defined by the radial directions. It must also be taken into account that the alignment of the ground structure in relation to the tangential reference direction can also change over different radial positions, even in this case always lying in the claimed angular range (of 15°-90°, in particular of 35°-70°). However, it may alternatively also remain constant. Furthermore, both the variant that the tangential reference direction runs clockwise and the variant that the tangential reference direction runs counterclockwise (in plan view of the rotating x-ray anode) are included. According to the present invention, at least in the case of one of these two possibilities, the angle of the alignment of the ground structure to the tangential reference direction should in each case lie in the desired angular range (for example of 15°-90°). Differences may occur here—depending on the application and direction of rotation of the rotating x-ray anode during use—whether the angle is set in relation to a clockwise tangential reference direction or in relation to a counterclockwise tangential reference direction. Which variant is to be preferred (depending on the respective application and on the direction of rotation of the rotating x-ray anode during use) must be determined in the individual case by tests.

It has been found in this respect that the formation of wide radial cracks, perceived to be particularly disadvantageous, can be avoided all the more effectively the greater the angle of inclination of the alignment of the ground structure is in relation to the tangential reference direction. Accordingly, the angle of inclination preferably lies in a range from and including 30° up to and including 90°. According to a development, over the circumference of the annular focal track and over the radial extent of the focal track, the alignment of the ground structure is inclined in relation to a tangential reference direction in the respective surface portion in each case by an angle in the range from and including 60° up to and including 90°. This variant is advantageous in particular whenever in the case of the rotating x-ray anode concerned it is intended in particular to compensate for strains in the tangential direction (or circumferential direction). An angle of the alignment in the range from at least 35° to at most 70° in relation to the tangential reference direction allows tensile stresses to be effectively compensated both in the radial direction and in the tangential direction. An optimum angular range can be respectively determined specifically in dependence on the geometry of the respective type of rotating x-ray anode and the materials used for it. Such a determination may be performed in particular with the aid of simulation.

According to a development, the course of the directed ground structure is essentially straight. Even such a course in which, on account of the (slight) curvature of the surface of the focal track or on account of the radially outwardly occurring widening, the course is slightly curved is also regarded as "essentially straight". Such a straight course of the ground structure may be achieved by a corresponding alignment of the grinding direction of the grinding means (or possibly also of the direction of movement of a polishing body or a brush) in relation to the tangential reference direction. Furthermore, it may be provided in this respect that the rotating x-ray anode is segmented in the region of the surface of the focal track to the extent that segments with a parallel alignment of the ground structure within the segment concerned respectively adjoin one another in the circumferential direction. This can be achieved within production particularly by a ground structure being introduced with a desired alignment on one circumferential segment of the rotating x-ray anode and then the rotating x-ray anode subsequently being rotated further by an angular increment, in order once again to introduce a ground structure with the desired (same) alignment in relation to the associated, tangential reference direction.

According to a development, along a radial direction from inside to outside, the angle between the alignment of the ground structure and a tangential reference direction in the respective surface portion decreases over the radial extent of the focal track. One way in which this is advantageous is with regard to simple production. Such a ground structure can be introduced in particular by the rotating x-ray anode being rotated during the introduction of the ground structure, while the direction of movement of the grinding means (or possibly also the direction of movement of a polishing body or a brush) is exclusively radial or possibly additionally has a tangential and/or an axial component.

According to a development, in the region of the ground structure, the mean surface roughness Ra lies in a range from and including 0.05 μm up to and including 0.5 μm. This range on the one hand offers a still sufficiently smooth surface with regard to the dose yield, on the other hand it offers sufficient crack nuclei for the formation of a fine crack network. Depending on the application and the conditions of use, different ranges may be suitable here. In particular, in the case of certain applications, a comparatively smooth surface is desired, and so the mean surface roughness Ra preferably lies in a range from and including 0.05 μm up to and including 0.15 μm. For many applications, an average range from and including 0.15 μm up to and including 0.3 μm of the mean surface roughness Ra is suitable. Furthermore, in the case of certain applications, a comparatively high roughness may also be permissible or desired, and so a ground structure with a mean surface roughness Ra from and including 0.3 μm up to and including 0.5 μm is suitable. A measuring section that runs straight and essentially perpendicularly to the alignment of the ground structure is used for the determination of the mean surface roughness. The profile is thereby measured with a contact probe advancing at 0.5 mm/s over a measuring section of 15 mm in length. The first and last 2.5 mm of the measured measuring section are not evaluated, but only the middle part of 10 mm in length. In the evaluation of the measurement data, a filter according to ISO 16610-31 is used. The determination of the mean surface roughness Ra is performed in accordance with DIN EN ISO 4287:2010-07.

According to a development, the ground structure extends beyond the region of the focal track. In particular, the ground structure extends both radially inwardly and radially outwardly beyond the region of the focal track. It is thereby taken into account that considerable thermal loads and also a deformation of the entire body of the rotating x-ray anode also occur in the region adjoining the focal track. This development makes it possible for the formation of a fine crack network also to be supported in this region.

According to a development, the material of the focal track in the region of the focal track is formed by tungsten or by a tungsten-based alloy. In particular, only a focal track layer formed on a carrier body is formed from the materials mentioned. The term tungsten-based alloy is used in particular to refer to an alloy that has tungsten as the main constituent, i.e. in a higher proportion (measured in percent by weight) than each of the other elements respectively contained. In particular, the focal track is formed from a tungsten-rhenium alloy, which may have a rhenium component of up to 26% by weight (% by weight: percent by weight). In particular, the rhenium component lies in a range of 5-10% by weight. The materials mentioned are advantageous with regard to the high thermal loads and with regard to highest possible emissivity of x-radiation.

According to a development, the entire body of the rotating x-ray anode or alternatively only the carrier body of the rotating x-ray anode (on which a focal track layer is formed) is formed from molybdenum or a molybdenum-based alloy (for example TZM or else MHC). These materials have proven to be particularly successful with regard to the high thermal and mechanical loads. The term molybdenum-based alloy is used in particular to refer to an alloy that has molybdenum as the main constituent, i.e. in a higher proportion (measured in percent by weight) than each of the other elements respectively contained. In particular, the molybdenum-based alloy may have a molybdenum component of at least 80% by weight (% by weight: percent by weight), in particular of at least 98% by weight. The term MHC is used in this context to denote a molybdenum alloy that has an Hf component of 1.0 to 1.3% by weight (Hf: hafnium), a C component of 0.05-0.12% by weight, an O component of less than 0.06% by weight and (apart from impurities) otherwise comprises molybdenum.

According to a development, the rotating x-ray anode has a carrier body and a focal track layer, which is formed on the carrier body and on which the focal track runs. In this way, the materials can be adapted on the one hand specifically to the requirements existing in the region of the focal track (high dose yield, high thermal load-bearing capacity) and on the other hand specifically to the requirements existing in the region of the carrier body (high mechanical load-bearing capacity, high thermal load-bearing capacity, good heat dissipation). In particular, the focal track layer, generally of an annular form, extends on both sides (i.e. radially inwardly and radially outwardly) beyond the focal track. If the surface of the focal track layer is also adjoined laterally (radially inwardly and/or radially outwardly) in the same plane by the surface of the carrier body, it is preferred that the ground structure extends beyond the focal track layer—in particular on both sides (i.e. radially inwardly and radially outwardly). As a result, a uniform transition between the focal track layer and the carrier body is achieved at the surface. According to a development, it is provided that the carrier body is formed from molybdenum or a molybdenum-based alloy (for example TZM, MHC, etc.) and that the focal track is formed from tungsten or a tungsten-based alloy.

The present invention also relates to a method for producing a rotating x-ray anode in which a directed ground structure is introduced at least in the region of an annular focal track of the rotating x-ray anode in such a way that, over the circumference of the annular focal track and over the radial extent of the focal track, the alignment of the ground structure is inclined in relation to a tangential reference direction in the respective surface portion in each case by an angle in the range from and including 15° up to and including 90°.

The method according to the invention is distinguished by the fact that a rotating x-ray anode in which the occurrence of fatigue effects in the region of the surface of the focal track can be considerably delayed can be provided by method steps that can be carried out in a simple, inexpensive and reproducible manner. In particular, rotating x-ray anodes with the features explained above and in the part of the description that follows can be produced by the method according to the invention. Accordingly, reference is made to the advantages explained in relation to the rotating x-ray anode also with reference to the method according to the invention. Furthermore, the developments and variants explained with reference to the rotating x-ray anode can also be realized in a corresponding way in the case of the method according to the invention, which can possibly be carried out by a corresponding adaptation of the method steps.

If the rotating x-ray anode has a carrier body and a focal track layer formed thereupon, there is in principle also the possibility that first the ground structure is introduced into the focal track layer and then the focal track layer is fastened on the carrier body (for example by brazing). It is preferred, however, that the ground structure is only introduced into the focal track layer when the focal track layer is already firmly connected to the carrier body (for example by the carrier body and the focal track layer being produced powder metallurgically as a composite, or by the focal track layer being applied to the carrier body by a vacuum plasma spraying process). In the case of the preferred variant, the occurrence of edges in the transition region between the focal track layer and the carrier body can be avoided.

According to a development, the step of introducing the ground structure forms the last working step, involving removal of material in the region of the surface of the focal track, in the production of the rotating x-ray anode.

As already explained above, the ground structure is introduced in particular by directed grinding, directed polishing and/or directed brushing (grinding is preferred here). In particular, a grinding means (for example a grinding wheel) covered with abrasive grains (for example silicon carbide or diamond) is used for the grinding. Such a grinding means is suitable in particular for a focal track material of tungsten or a tungsten-based alloy (for example a tungsten-rhenium alloy).

According to a development, to introduce the ground structure, a grinding body is moved in such a way that its grinding surface moves at least partly in the radial direction, and that furthermore the grinding body and the focal track are moved in relation to one another in the circumferential direction (continuously during the introduction of the ground structure or intermittently by an angular increment in each case between the working steps). In particular, to realize the relative movement in the circumferential direction, the rotating x-ray anode is rotated about its axis of symmetry. As already explained above, this achieves a relatively simple and inexpensive way of introducing the ground structure.

BRIEF DESCRIPTION OF THE SEVERAL VIEWS OF THE DRAWING

Further advantages and expedient aspects of the invention emerge from the following description of exemplary embodiments with reference to the accompanying figures, in which.

DESCRIPTION OF THE INVENTION

Figure 1:
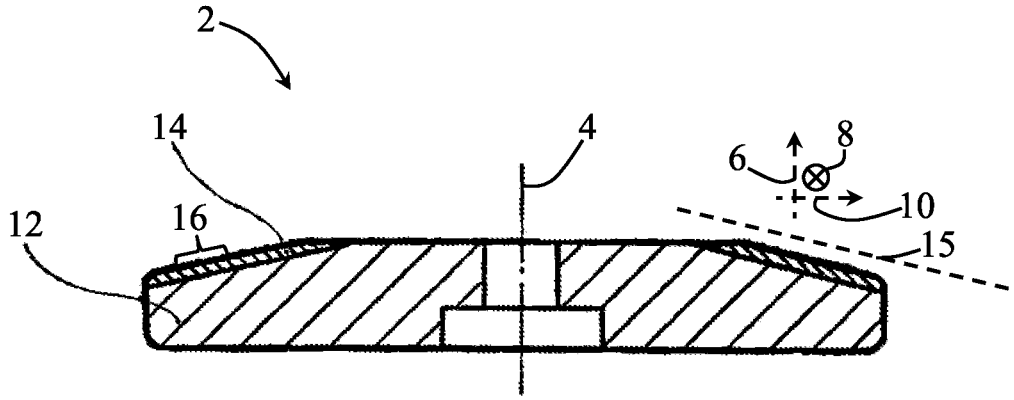
FIG. 1 shows a schematic cross-sectional view of a rotating x-ray anode.

In FIG. 1, the structure of a rotating x-ray anode -2- is schematically represented. The rotating x-ray anode -2- is formed rotationally symmetrically in relation to an axis of rotational symmetry -4-. Determined at the same time by the axis of rotational symmetry -4- is an axial direction -6-, which respectively runs through the point to be characterized that is concerned and parallel to the axis of rotational symmetry -4-. Running perpendicularly to the axial direction -6- are the tangential direction -8- (depicted in the present case as counter to the clockwise direction), which respectively forms a tangent to the circumference at the point concerned, and the radial direction -10-, which is perpendicular to the tangential direction -8- and the axial direction -6-. The rotating x-ray anode -2- has a disk-shaped carrier body -12-, which can be mounted on a corresponding shaft. Applied to the carrier body -12- on the top side is an annular focal track layer -14-. The portion over which the annular focal track layer -14- extends has the form of a truncated cone (of a flat cone). The inclination of the surface of the focal track layer -14- is represented in FIG. 1 by the dashed line 15. The inclination is, for example, 12° in relation to the radial direction -10-. The focal track layer -4- covers at least the region of the carrier body -12- that is intended for scanning with an electron beam, and consequently forms the focal track -16-. In the present case, the focal track layer -14- extends on both sides (i.e. both radially inwardly and radially outwardly) beyond the portion of the focal track -16- that is schematically indicated in FIG. 1 by the curly bracket.

Figure 2:
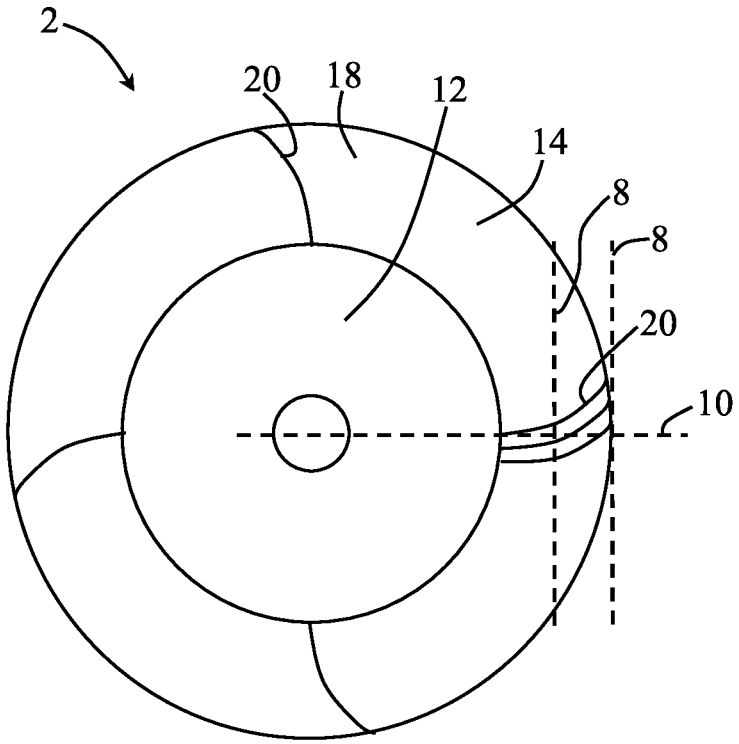
FIG. 2 shows a schematic plan view of a rotating x-ray anode according to the invention, as provided by a first embodiment, from above.
Figure 3:
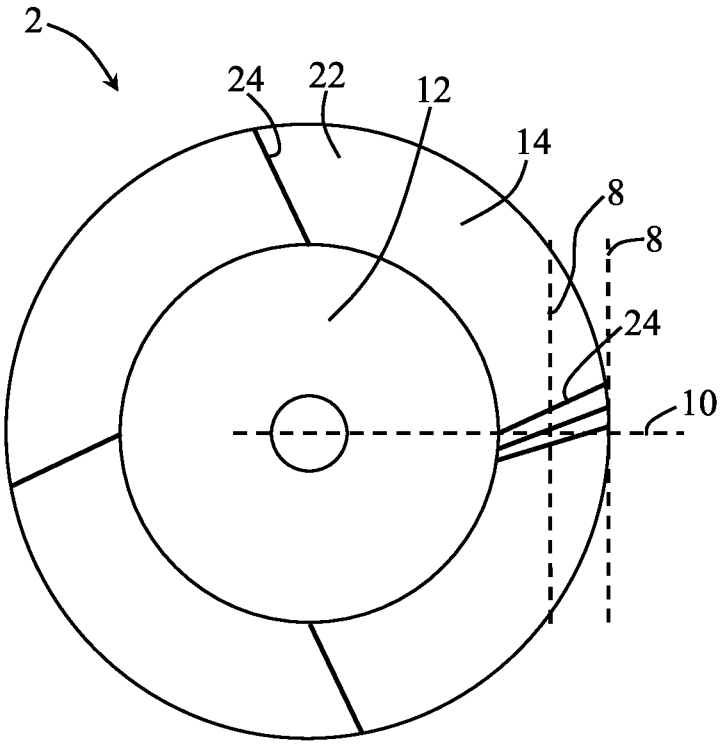
FIG. 3 shows a schematic plan view of a rotating x-ray anode according to the invention, as provided by a second embodiment, from above.

Two embodiments of the present invention are explained below with reference to FIGS. 2 and 3. A schematic plan view of a rotating x-ray anode -2- is respectively represented here in FIGS. 2 and 3. The rotating x-ray anode -2- is in this case constructed in a way corresponding to the rotating x-ray anode -2- represented in FIG. 1, and the same reference numerals are in turn used for the same components. In FIGS. 2 and 3, the tangential reference direction -8- is depicted for two different radial positions (for two points to be characterized, in each case lying on a horizontally running radial direction -10-).

In the case of the first embodiment, represented in FIG. 2, a directed ground structure -18- is provided, extending over the entire inclined surface of the focal track layer -14-. At individual circumferential portions of the focal track layer -14-, the alignment of the ground structure -18- is schematically depicted as individual lines -20-. The lines -20- are merely used here to indicate the alignment of the ground structure and do not represent individual grinding striae. This is so because, as explained above, the latter are randomly distributed and have different dimensions. It is just that the course of said striae extends essentially along the indicated lines -20-. The ground structure -18- of the first embodiment, represented in FIG. 2, has a curved alignment. Along a radial direction -10- from inside to outside, the angle between the alignment of the ground structure -18- and a tangential reference direction -8- decreases over the extent of the focal track layer -14- in the respective surface portion. Such a ground structure -18- can be introduced in particular by the rotating x-ray anode -2- being rotated during the introduction of the ground structure -18-, while the direction of movement of the grinding means is exclusively radial or possibly additionally has a tangential and/or an axial component (for example introduction by using a five-axes grinding machine). Such a direction of movement of the grinding means may be obtained in particular by rotation of a cup wheel with corresponding alignment of the axis of rotation.

In the case of the second embodiment, represented in FIG. 3, a directed ground structure -22- is provided, in turn extending over the entire inclined surface of the focal track layer -14-. The ground structure -22- is formed in such a way that segments with a parallel alignment of the ground structure -22- within the segment concerned respectively adjoin one another in the circumferential direction. At individual circumferential portions of the focal track layer -14-, the alignment of the ground structure within the respective segment is schematically depicted as individual lines -24- in a way corresponding to the first embodiment. The directed ground structure -22- of the second embodiment, represented in FIG. 3, has within the respective segment an essentially straight course. On account of the enlargement of the circumference along the radial direction -10- from the inside outward, the individual segments are in each case narrower in the radially inner region than in the radially outer region. Over the (relatively small) radial extent of the focal track -16- (cf. FIG. 1), the alignment of the ground structure -22- in relation to the tangential reference direction -8- remains essentially constant.

It has been found that the provision of the ground structure according to the invention with an alignment in a range from and including 15° up to and including 90° in relation to the tangential reference direction has the effect that a much finer and more uniform crack network is formed during the use of the rotating x-ray anode than according to the (internal) prior art with an alignment of the ground structure in the tangential direction. An angle in the range from and including 35° up to and including 70°, in which the microcracks induced by the ground structure with their accumulated crack width compensate for the overall deformation of the focal track occurring during use, both in the radial direction and in the tangential direction, has been found to be particularly advantageous here. This produces a uniform array of fine microcracks, running essentially along the alignment of the ground structure, instead of a branching network of tangential and radial cracks intersecting one another or running into one another. As a result, the load-bearing capacity and the lifetime of the rotating x-ray anodes according to the invention are increased.

It is also advantageous that, on account of the formation of the fine microcracks, the rotating x-ray anodes according to the invention have in addition to the increase in bursting resistance and high-voltage stability also a significantly slowed decline in dose over the lifetime of the rotating x-ray anode. This is attributed to the following effects: on the one hand, the crack widths and crack depths are reduced; on the other hand, the microcracks have a radial component. Both effects contribute during use to a reduction in the self-absorption of the x-radiation, and consequently to a comparatively high dose yield.

Exemplary Embodiment

Rotating x-ray anodes with a focal track layer of a tungsten-rhenium alloy (10% by weight rhenium, 90% by weight tungsten), which was firmly connected to the carrier body of a molybdenum alloy, were first pre-smoothed by fine turning. After the fine turning of the focal track layer, a directed ground structure was introduced with a fine-grained diamond cup grinding wheel. The diamond cup grinding wheel had a grain size of D76, given in accordance with the standard issued by the FEPA (Fédération Européene des Fabricants de Produits Abrasifs [Federation of European Producers of Abrasives]). To introduce the ground structure, an arrangement in which the axis of rotation of the diamond cup grinding wheel was aligned essentially perpendicularly to the surface of the focal track (with respect to the point of contact of the cup wheel with the focal track) and essentially in the middle of the focal track with respect to the radial direction was chosen. The arrangement was also chosen in such a way that an annular ground surface, formed on the end face of the diamond cup grinding wheel and aligned perpendicularly to the axis of rotation (of the diamond cup grinding wheel), engaged in a grinding manner in the surface of the focal track during the rotation of said wheel on a circumferential portion (of the rotating diamond cup grinding wheel), while the opposite circumferential portion was kept at a distance from the focal track. To introduce the ground structure, in this arrangement the diamond cup grinding wheel and the rotating x-ray anode were respectively rotated about their axes of rotation, with oil being used as a lubricant. The inclination of the alignment of the introduced ground structure in relation to the tangential reference direction depends on the relative speeds of the focal track in relation to the ground surface of the diamond cup wheel. In particular, the rotational speed of the diamond cup grinding wheel must be sufficiently high in relation to the rotational speed of the rotating x-ray anode in order to achieve an inclination of the alignment of the ground structure in relation to the tangential reference direction. In the present case, the rotating x-ray anode was rotated at 100 revolutions per minute, with the focal track extending over a radius of about 75 mm to about 100 mm of the rotating x-ray anode, and the diamond cup grinding wheel having a speed of 20 m/s (meters/second) in the region of the ground surface. The ground structure obtained thereby was aligned essentially straight, having a slight curvature on account of the radius (in the present case 62.5 mm) of the diamond cup grinding wheel. The alignment of the ground structure was inclined about 85°-90° in relation to the tangential reference direction (i.e. ran approximately radially). The mean roughness of the directed ground structure was Ra=0.25 μm.

The present invention is not restricted to the exemplary embodiments explained above. In particular, the outer form and the structure of the rotating x-ray anode, as known in the art, may deviate from the rotating x-ray anode -2- represented in the figures. In particular, it may also be provided that the focal track layer covers only part of the frustoconical portion and the surface of the focal track layer is adjoined radially inwardly and/or radially outwardly in the same plane by the surface of the carrier body. In this case, the (inclined) surface portions concerned of the carrier body may also be provided with a ground structure. Furthermore, it is also possible that the rotating x-ray anode does not have a separate focal track layer and the focal track is formed on an essentially monolithic body (apart from attachments such as for example a graphite ring, etc.). Furthermore, in addition to the production steps described, it may be provided within production that the surface concerned is smoothed to the greatest extent possible before the introduction of the ground structure, in order to eliminate as far as possible the influences of existing structures on the surface. Such smoothing may be performed for example by mechanical polishing and/or electropolishing. Furthermore, there is also the possibility of introducing two arrays of striae, which cross one another. In particular, the rotating x-ray anode may first be coarsely pre-turned in the circumferential direction, in order to introduce relatively coarse striae that are aligned in the circumferential direction. The mean surface roughness obtained by the coarse turning may for example be around Ra=2 μm. The directed ground structure according to the invention, which extends at least predominantly in the radial direction, may then be introduced in such a way that the striae resulting from the turning are at least partially retained. In this way, striae, and consequently directed crack nuclei, that have at least two different alignments on the respective surface portions, and accordingly support the formation of a fine crack network, are provided.

The invention claimed is:

1. A rotating x-ray anode, comprising:

an annular focal track having a surface formed with a directed ground structure;

an alignment of the directed ground structure, over a circumference of said focal track and over a radial extent of said focal track, being inclined in relation to a tangential reference direction at a respective surface portion by an angle in a range from 15° to 90°, wherein the range includes 15° and 90°; and wherein the directed ground structure is a surface structuring that is formed by a uniformly distributed array of individual striae or individual grooves that are aligned along a preferential direction, and wherein the individual striae or individual grooves have a randomly distributed arrangement and randomly distributed dimensions.

2. The rotating x-ray anode according to claim 1, wherein, over the circumference of said annular focal track and over the radial extent of said focal track, the alignment of the ground structure is inclined in relation to the tangential reference direction in the respective surface portion in each case by an angle in a range from 35° to 70°, wherein the range of 35° to 70° includes 35° and 70°.

3. The rotating x-ray anode according to claim 1, wherein the directed ground structure in each case has a substantially straight course.

4. The rotating x-ray anode according to claim 1, wherein, along a radial direction from inside to outside, the angle between the alignment of the ground structure and the tangential reference direction in the respective surface portion decreases over the radial extent of said focal track.

5. The rotating x-ray anode according to claim 1, wherein, in a region of the ground structure, a mean surface roughness Ra lies in a range from 0.05 μm to 0.5 μm, wherein the range from 0.05 μm to 0.5 μm includes 0.05 μm and 0.5 μm, wherein a measuring section that runs straight and substantially perpendicularly to the alignment of the ground structure is used for determining the mean surface roughness.

6. The rotating x-ray anode according to claim 1, wherein the ground structure extends beyond a region of said focal track.

7. The rotating x-ray anode according to claim 1, wherein a material of said focal track at said focal track is tungsten or a tungsten-based alloy.

8. The rotating x-ray anode according to claim 1, wherein said anode has a carrier body and a focal track layer, which is formed on said carrier body and on which said focal track runs.

9. A method of producing a rotating x-ray anode, the method comprising:

introducing a directed ground structure into at least a region of an annular focal track of the rotating x-ray anode such that, over a circumference of the annular focal track and over a radial extent of the focal track, an alignment of the ground structure is inclined in relation to a tangential reference direction in the respective surface portion in each case by an angle in a range from 15° to 90°, wherein the range includes 15° and 90°; and wherein the directed ground structure is a surface structuring that is formed by a uniformly distributed array of individual striae or individual grooves that are aligned along a preferential direction, and wherein the individual striae or individual grooves have a randomly distributed arrangement and randomly distributed dimensions.

10. The method according to claim 9, wherein the step of introducing the ground structure is a last working step involving removal of material in the region of the surface of the focal track, in a production of the rotating x-ray anode.

11. The method according to claim 9, wherein the introducing step comprises grinding the ground structure into the x-ray anode.

12. The method according to claim 9, wherein the step of introducing the ground structure comprises moving a grinding body such that a grinding surface thereof moves at least partly in the radial direction, and that furthermore the grinding body and the focal track are moved in relation to one another in the circumferential direction.

* * * * *